United States Patent [19]

Hoeffken

[11] 4,298,061

[45] Nov. 3, 1981

[54] HEAT EXCHANGER WITH CRIMPED FLANGE SEAM

[75] Inventor: Russell W. Hoeffken, Belleville, Ill.

[73] Assignee: The Singer Company, Stamford, Conn.

[21] Appl. No.: 178,338

[22] Filed: Aug. 15, 1980

[51] Int. Cl.[3] ..... F24H 3/00; F28F 3/10; F28F 3/12

[52] U.S. Cl. ..... 165/170; 29/157.3 D; 29/463; 113/118 D; 126/116 R; 220/77

[58] Field of Search ..... 165/170; 29/157.3 D, 29/157.3 V, DIG. 3, 463, 521; 113/118 D, 118 V, 1 C; 220/77; 126/116 R

[56] References Cited

U.S. PATENT DOCUMENTS

| | | | |
|---|---|---|---|
| 700,575 | 5/1902 | Thompson | 29/521 |
| 759,318 | 5/1904 | Sayre | 126/116 R |
| 1,037,754 | 9/1912 | Gildersleeve | 113/118 D |
| 1,406,875 | 2/1922 | Moulton | 29/521 |
| 2,486,822 | 11/1949 | Cameron | 165/170 |
| 2,845,284 | 7/1958 | Kallstrom | 113/1 C |
| 3,757,855 | 9/1973 | Kun et al. | 29/157.3 D |
| 3,807,382 | 4/1974 | Kennedy | 126/116 R |
| 3,813,752 | 6/1974 | Bemrose et al. | 29/157.3 D |
| 3,893,509 | 7/1975 | Satchwell et al. | 165/166 |
| 4,119,144 | 10/1978 | Kun | 29/157.4 |

FOREIGN PATENT DOCUMENTS

| | | | |
|---|---|---|---|
| 819022 | 10/1937 | France | 165/170 |
| 1232273 | 10/1960 | France | 165/170 |

*Primary Examiner*—Sheldon J. Richter
*Attorney, Agent, or Firm*—William V. Ebs; Robert E. Smith; Edward L. Bell

[57] ABSTRACT

The sides of a heat exchanger unit are joined with perimeter flanges which are folded one over the other and then crimped tightly in such fashion as to cause adjacent portions of the perimeter to extend at different angles in different planes resulting in a scissor action therebetween effective to securely clamp the heat exchanger sides together and form a leak-proof chamber.

4 Claims, 6 Drawing Figures

HEAT EXCHANGER WITH CRIMPED FLANGE SEAM

DESCRIPTION

1. Field of the Invention

The invention relates to gas-fired furnaces and more particularly to heat exchanger units for use in such furnaces.

2. Description of the Prior Art

Gas-fired furnaces commonly include one or more clam shell type heat exchanger units. Conventionally, the clam shell sides of such a unit have been joined by spot welding, seam welding, arc welding, tig welding, mig welding or plasma welding. However, these welding procedures are costly. Furthermore, the resulting structure is susceptible to cracking because of the stresses which are introduced during the welding processes and which are aggravated by expansion and contraction of the metal of the heat exchanger unit during on and off cycles of the furnace. Another disadvantage of welding is the presence of noxious fumes which are produced during the welding process, and which result not only in a loss of comfort and healthful air in the vicinity of activity within a manufacturing facility, but result in an increased level of pollution of the outside air into which the fumes must ultimately be expelled.

It is a prime object of this invention to provide an improved construction for the heat exchanger unit of a hot air furnace permitting clam shell sides of the unit to be securely joined without welding in such manner that undesirable relative movement of the sides during on and off cycles of the furnace is prevented.

It is another object of the invention to provide an improved construction for the heat exchanger unit of a hot air furnace enabling clam shell sides to be securely joined without welding in such manner as to form a leakproof seal between adjoining edge portions.

It is still another object of the invention to provide an improved no-weld process for securely clamping complementary sides of a heat exchanger unit together along the edges thereof.

Other objects and advantages of the invention will become apparent hereinafter.

SUMMARY OF THE INVENTION

In accordance with the invention, complementary clam shell sides of a heat exchanger for a hot air furnace are provided with perimeter flanges. The flanges of the clam shell are folded one over the other to form a seam and are crimped tightly into a leakproof joint in a manner causing adjacent portions of the perimeter of the joined clam shell sides to subtend an angle therebetween resulting in a scissor action at their juncture effective to securely lock the clam shells together and prevent undesirable relative movement thereof during on and off cycles of the furnace.

DESCRIPTION OF THE PREFERRED EMBODIMENT

Figures 1, 2:
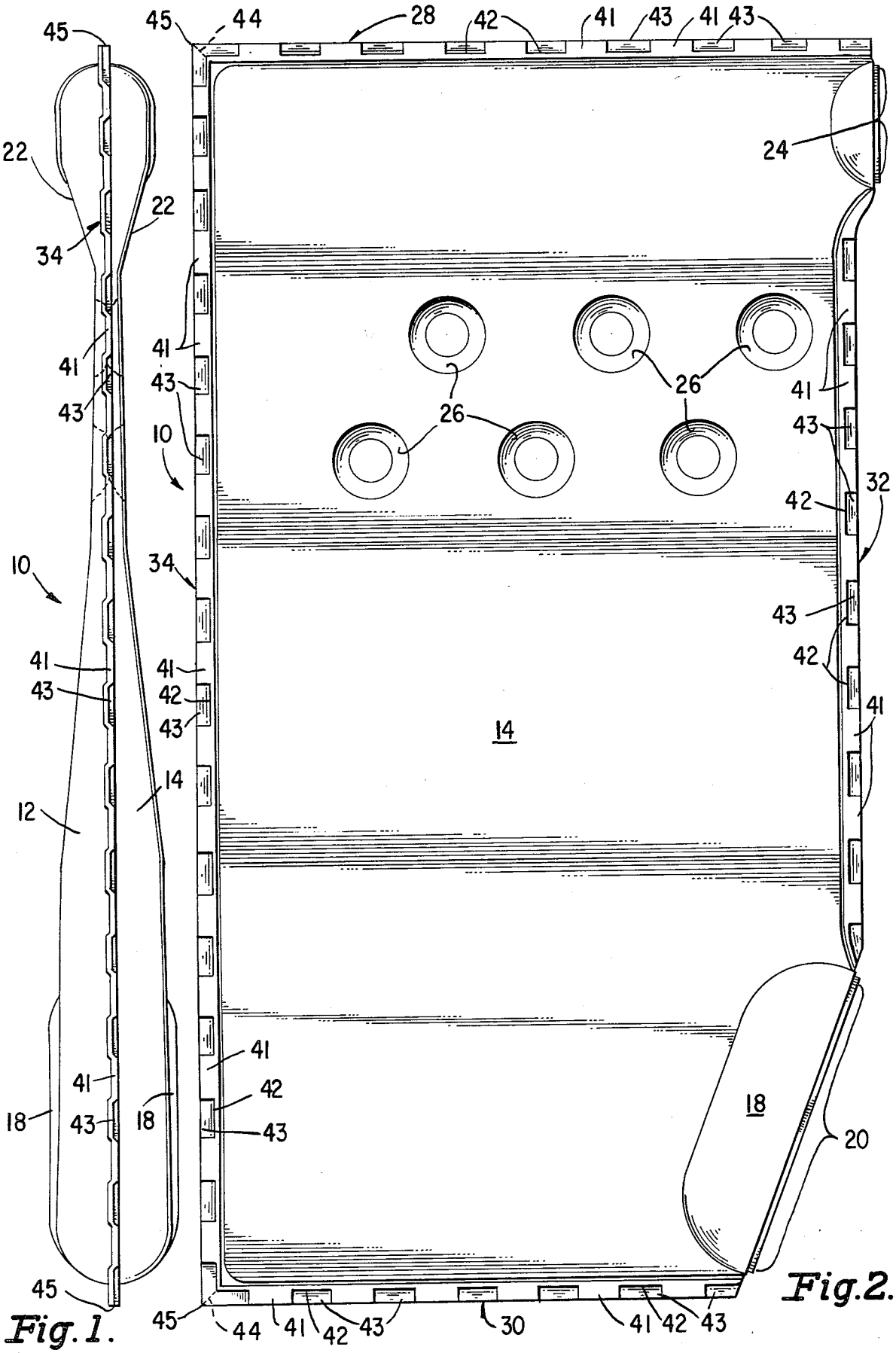
FIG. 1 is a rear elevational view of a heat exchanger unit for a gas-fired furnace showing a crimped edge and angular deflections along the edge according to the invention.
FIG. 2 is a side elevational view of the heat exchanger unit showing the crimped edge about the perimeter of the unit.

Referring to the drawings, and in particular to FIGS. 1 and 2, reference character 10 designates a gas furnace heat exchanger unit including clam shell sides 12 and 14 which are joined in accordance with the invention as hereinafter described to form a chamber 16. A lower pouch section 18 of the heat exchanger is provided with an opening 20 for the reception of means such as a gas burner (not shown) for firing the unit, and an upper portion 22 of the heat exchanger is formed with an upwardly diverging taper as shown in FIG. 1 to collect combustion products as they migrate toward a smoke exit 24. Depressions 26 formed in the sides of the heat exchanger unit prevent closure of the heated chamber during the heating cycle.

Figure 4:
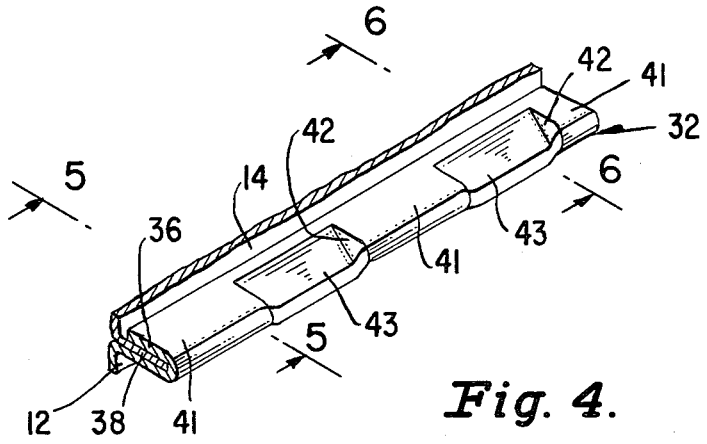
FIG. 4 is a fragmentary perspective view showing a crimped edge of the heat exchanger.
Figure 3:
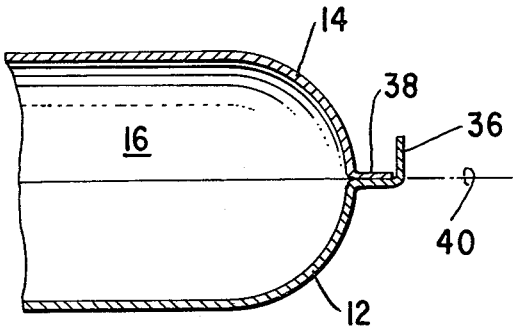
FIG. 3 is a cross-sectional view showing a perimeter flange of the heat exchanger prior to crimping.
Figure 5:
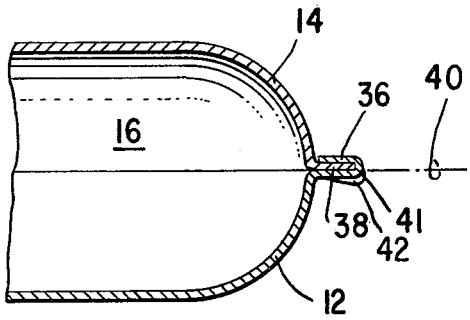
FIG. 5 is a cross-sectional view along the line 5—5 of FIG. 4.
Figure 6:
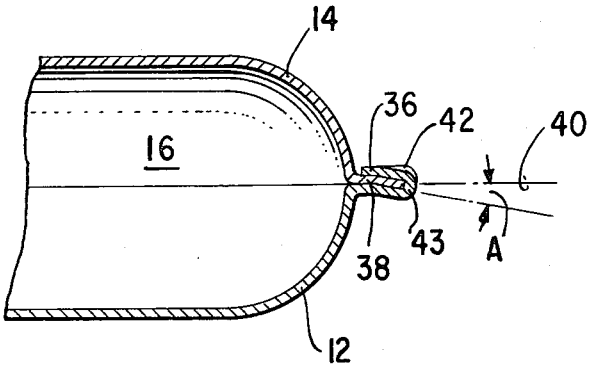
FIG. 6 is a cross-sectional view along the line 6—6 of FIG. 4.

The clam shell heat exchanger is sealed around its perimeter in accordance with the invention at each of top, bottom, front and rear edges 28, 30, 32 and 34 respectively. At each such edge, a flange 36 on clam shell side 12 extending beyond and at right angles to a flange 38 on clam shell side 14 (see FIG. 3) is folded over and forced against and crimped with the flange 38 to seal the edge in at last two different planes (see FIG. 4). Preferably, each of the edges 28, 30, 32 and 34 is crimped as indicated for the edge 32 in FIGS. 4, 5 and 6, that is into one set of edge portions extending parallel to the central longitudinally extending clam shell dividing plane 40 of the heat exchanger at a plurality of lengthwise spaced locations 41, and therebetween at locations 43 into another set of edge portions extending at an acute angle A with respect to said plane to thereby create a scissors action on the small areas 42 along the perimeter between these planes. Such action securely locks the two clam shell sides 12 and 14 together preventing undesirable relative movement thereof during on and off cycles of the furnace and avoids the need to spot weld the heat exchanger sides together.

Flanges 36 come together along mitered edges 44 at right angled corners 45 of the heat exchanger 10 where a leakproof seal is achieved by forcing a portion of the material into whatever crevices there may be between the mitered edges to form what is essentially an integral radius corner. The desired result is readily achieved in a fraction of a second as flange material is squirted into the unoccupied crevices.

Conventional tooling and equipment which has been modified as required to accommodate the dimensions and configuration of the heat exchanger may be utilized to crimp and seal edges 28, 30, 32 and 34 of the heat exchanger as described. The equipment, may, for example, be hydraulic, or mechanical and have single or multiple stroke capability. Preferably, the equipment is adapted to permit the various edges to be crimped and sealed in a single operation.

A coating may be applied to the heat exchanger unit without significantly changing the configuration to provide corrosion protection and/or improve the heat transfer capability of the furnace wherein the heat exchanger units are to be utilized.

After the formation of one or more heat exchanger units 10 as described, a pouch plate and partition plate are secured to lower and upper portions, thereof preferably in the manner shown and described in my copending patent application for "Heat Exchanger and Plate Assembly" Ser. No. 178,337 filed Aug. 15, 1980. The assembly may then be secured and sealed to the sides of the furnace to isolate air to be heated by heat exchanger units in the rear of the furnace from furnace controls in the front.

While the present disclosure relates to a preferred embodiment of the invention, it is for purposes of illustration only and is not to be construed as a limitation of the invention. Numerous alterations and modifications of the structure herein disclosed will suggest themselves to those skilled in the art, and all such modifications and alterations which do not depart from the spirit and scope of the invention are intended to be included within the scope of the appended claims.

We claim:

1. A heat exchanger unit for a hot-air furnace having complementary sides with engaged flanges along one or more edges of the unit where a flange on one side is folded over a flange on the other side, the folded flange on the one side and flange on the other being crimped together along resulting seams into one set of lengthwise spaced edge portions extending in one direction with respect to a longitudinal plane dividing the complementary sides of the heat exchanger, and into another set of longitudinally spaced edge portions extending between the first mentioned portions in another direction with respect to the said plane.

2. A heat exchanger unit as defined in claim 1 wherein said one set of crimped edge portions extend substantially parallel to the longitudinal plane dividing the heat exchanger, and the other crimped edge portions extend at an acute angle with respect to the said plane.

3. A heat exchanger unit for a hot-air furnace having complementary sides with engaged flanges along a top edge, bottom edge, front edge, and rear edge of the unit where a flange on one side is folded over a flange on the other side, the folded flange on the one side and flange on the other along each resulting seam being crimped together into one set of lengthwise spaced edge portions extending in one direction with respect to a longitudinal plane dividing the complementary sides of the heat exchanger, and into another set of longitudinally spaced edge portions extending between the first mentioned edge portions in another direction with respect to the said longitudinal plane.

4. A heat exchanger unit according to claim 3 wherein the folded flanges meet along mitered edges at corners of the heat exchanger and flange material forced between such edges forms a leakproof joint.

* * * * *